United States Patent [19]

Ezoe

[11] 4,053,998

[45] Oct. 18, 1977

[54] MULTI-BLADE DITCHING MACHINE

[75] Inventor: Takuji Ezoe, Tokyo, Japan

[73] Assignee: Kokusai Cable Ship Co., Ltd., Tokyo, Japan

[21] Appl. No.: 637,188

[22] Filed: Dec. 3, 1975

[30] Foreign Application Priority Data

Dec. 27, 1974 Japan ..... 50-148882

[51] Int. Cl.[2] ..... E02F 5/02

[52] U.S. Cl. ..... 37/98; 37/54; 61/72.4; 172/146

[58] Field of Search ..... 61/72.1, 72.4, 72.5, 61/72.6, 72.7; 37/98, 71, 54; 172/382, 195, 196, 145, 146

[56] References Cited

U.S. PATENT DOCUMENTS

| | | | |
|---|---|---|---|
| 843,386 | 2/1907 | Benson | 37/98 |
| 1,287,291 | 12/1918 | Gordon | 172/382 |
| 2,992,537 | 7/1961 | Callahan | 61/72.4 |
| 3,339,368 | 9/1967 | Ezoe et al. | 61/72.4 |
| 3,824,798 | 7/1974 | Shiroyama | 61/72.4 |
| 3,898,852 | 8/1975 | Ezoe | 61/72.4 |

FOREIGN PATENT DOCUMENTS

| | | | |
|---|---|---|---|
| 759,050 | 1/1934 | France | 37/98 |
| 947,014 | 6/1949 | France | 37/98 |
| 66,401 | 1/1892 | Germany | 172/196 |
| 1,189,602 | 8/1961 | Germany | 61/72.6 |
| 41,888 | 5/1959 | Poland | 61/72.5 |
| 230,535 | 3/1925 | United Kingdom | 172/146 |
| 548,001 | 9/1942 | United Kingdom | 37/98 |

*Primary Examiner*—Edgar S. Burr
*Assistant Examiner*—Steven A. Bratlie
*Attorney, Agent, or Firm*—Armstrong, Nikaido & Marmelstein

[57] ABSTRACT

A ditching machine for digging a ditch for submarine cable comprising at least a plurality pairs of blades disposed along the longitudinal direction of the ditching machine. At least the blades in a forward position have a ditching portion which ditches soil and a soil-pushing portion which pushes away the soil thus ditched substantially horizontally in a direction lateral to the moving direction of the ditching machine. Said soil-pushing portion is at the top of said ditching portion and has a wider horizontal width as seen from front of the ditching machine than that of said ditching portion when the ditching machine is in a normal operating posture.

3 Claims, 11 Drawing Figures

MULTI-BLADE DITCHING MACHINE

BACKGROUND OF THE INVENTION

This invention relates to a multi-blade ditching machine which is used for burying submarine cables or the like in the sea floor and/or for pulling them above the water surface, and more particularly to an improvement in blades of multi-blade ditching machine.

To protect submarine cables or the like from fishing tools, it has been the practise in many countries of the world to bury the cables or the like in the sea floor and to pull out such buried cables or the like by ditching a ditch for repair in case of faults. For this purpose, ditching machines which ditch the soil or sediment of the sea floor to a predetermined depth have been used, and such ditching machines are called cable-buriers or cable-searchers depending on the purposes thereof.

Although the structure of the cable-buriers is somewhat different from that of the cable-searchers due to the difference in their purposes, the essential ditching portions of both the cable-buriers and cable-searchers are similar to each other, and such ditching portions use water jets or plows for ditching ditches on the sea floor. Conventionally, two types of ditching portions with plows have been used, i.e., single-blade type ditching portions and multi-blade type ditching portions.

With a conventional multi-blade ditching machine, the soil ditched by any one blade is placed in a space defined by the difference of the effective widths between that blade and the immediately preceding blade. In order to restrict the height of the excavated soil below a certain limit (for instance, below twice the excavating depth, which limit can be set as high as about four times the excavating depth) the effective widths of the adjustment blades should be increased by a factor of 1.5 as the position of the blade is forwarded. If the number of blades in one ditching machine is increased in excess of four, the widths of the leading blades become large, resulting in large ditching areas which mean large ditching resistances. Accordingly, the overall ditching resistance of the ditching machine cannot be reduced. Therefore conventionally, the four-blade excavator is generally accepted as providing the minimum ditching resistance.

As explained above, each blade of the conventional multi-blade ditching machine has a portion which pushes away the ditched soil over the same width as the ditching width, so as to provide a space for ditching and soil push-away by the next succeeding blade. Thus, the conventional multi-blade ditching machine has a shortcoming in that each blade thereof is required to have an unnecessarily broad effective width in order to restrict the height of the soil ditched by the next following blade thereof, and each blade thereof requires the immediately preceding blade thereof to have a still broader effective width for the same reason.

SUMMARY OF THE INVENTION

It is an object, therefore, of the present invention to overcome the disadvantages and limitations of a prior ditching machine by providing a new and improved multi-blade plow type ditching machine, in which the width of at least the foremost blade, preferably a few foremost blades, is partially expanded to a soil-pushing width that is broader than the ditching width, whereby, the efficiency of the conventional four-blade ditching machine is improved and the number of blades in a multi-blade ditching machine can be increased in excess of four.

The above and other objects are attained by a multi-blade ditching machine having a plurality of blades disposed along a longitudinal direction of the ditching machine substantially at uniform intervals. Said blades, as they are positioned more rearwardly in the ditching machine, are adapted to ditch more deeply with narrower ditching widths. At least the forward one of the blades has a ditching portion which ditches soil and a soil-pushing portion which pushes away the soil thus ditched substantially horizontally in a direction lateral to the moving direction of the ditching machine. Said soil-pushing portion is at the top of said ditching portion and has a wider horizontal width as seen from front of the ditching machine than that of said ditching portion when the ditching machine assumes a normal operating posture.

BRIEF DESCRIPTION OF THE DRAWINGS

The foregoing and other objects, features, and attendant advantages of the invention will be appreciated as the same become better understood from the following description and the accompanying drawings wherein.

DETAILED DESCRIPTION OF THE PREFERRED EMBODIMENT

Figure 1A:
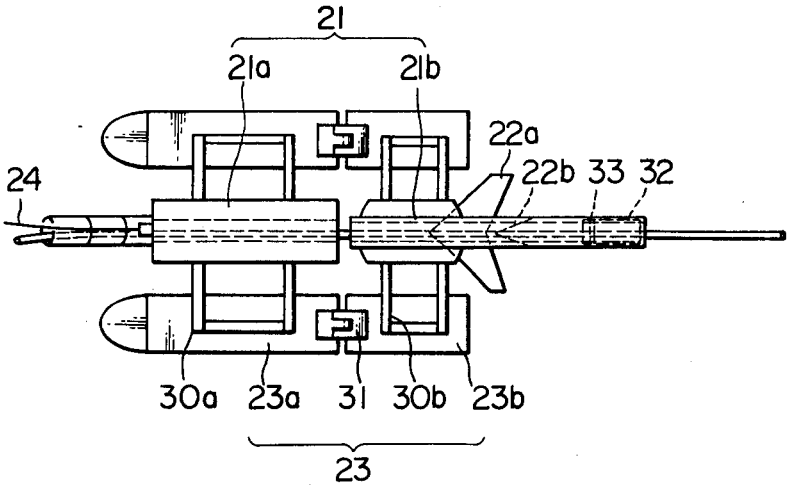
FIG. 1A is a plane view of a prior ditching machine.
Figure 1B:
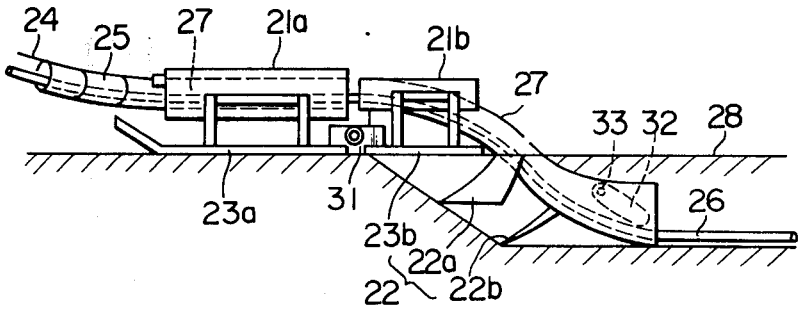
FIG. 1B is an elevational view of the same.

First, a conventional multi-blade ditching machine will be described, before entering into the details of the present invention, to facilitate easy understanding of the present invention. FIGS. 1(A) and 1(B) show a structure of the prior ditching machine, which is described in the U.S. Pat. No. 3,898,852, owned by the present applicant. In FIGS. 1(A), and 1(B), the reference numeral 21 (21*a*, 21*b*) is a pair of main bodies, 22 (22*a*, 22*b*) is a pair of cutting blades, 23 (23*a*, 23*b*) is a pair of identical sliding stabilizing sledges, 24 is a pull wire, 25 is a cable guiding means, 26 is a submarine cable, 27 is a cable path, 28 is sea bottom, 30 (30*a*, 30*b*) is a pair of supporting means extending laterally from the main bodies, 31 is a pair of joints, 32 is a press block and 33 is a pin for pivotablly connecting said press block 32 to said cable path 27.

Figure 1C:
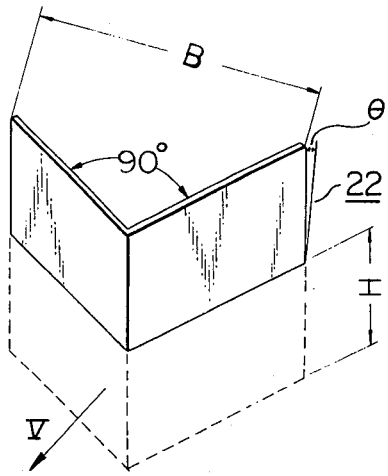
FIG. 1C is a structure of a blade of the prior ditching machine.

FIG. 1(C) illustrates the blade 22 which is used in any one stage of a conventional multi-blade ditching machine but FIG. 1(C) is illustrated as scoop angle $\theta=0$ for the sake of the simplicity of the explanation. As shown in the figure, the blade 22 has an edge formed of two planar blade elements which cross each other at the edge with an angle (to be referred to as a "retard angle") of 90°, and an effective width B is defined by the two blade elements. It has been found by experiments that, if the lower part of the blade of FIG. 1(C) is vertically forced into soil by a depth H, as shown by dotted lines in FIG. 1(C), and if the blade is moved in a horizontal direction $v$ at right angles to the direction of the effective width B, the ditching resistance R is proportional to $BH^2$ in the case of $B>2H$, and the resistance R is proportional to $(C+B)H^2$ (C being a constant) in the case of $B<H$. Thus, when the width of a ditch is small compared to the depth thereof, the ditching resistance R cannot be reduced below a certain limit however narrow the ditch may be. Consequently, it has been confirmed by experiments that, as compared with the excavation of a ditch with a certain width and a certain depth in one step by using a single blade, the ditching resistance R can be reduced by ditching and deepening such a ditch in a plurality of steps by using a multi-blade means consisting of a plurality of blades having the same width as the ditch width. The experiments also showed that the ditching resistance R can be further reduced by using wider blades in the forward stages of the aforesaid multi-blade means and reducing the blade width as the blades are positioned more rearwardly, until the desired blade width is reached at the most rearward stage thereof.

Figure 2:
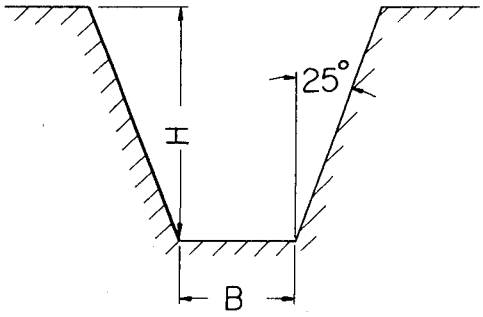
FIG. 2 and FIG. 3 are diagrams for general description of ditching and push-away of the ditched soil.

It was found through similar experiments that, when a deep ditch is ditched with a uniform width, the soil at obliquely upward side portions of the ditch resists the ditching action of the blade on both the left-hand side and the right-hand side thereof. Thus, it is preferable to remove the soil from such obliquely upward side portions beforehand, and in the case of the multi-blade ditching, a ditch is preferably ditched in layers, starting from the top layer so as to form a "V-shaped" cross section. If the angle between the side wall of a ditch and a vertical plane is 25° or larger, as shown in FIG. 2, the ditching resistance R for ditching the ditch with a multi-blade means is empirically given by $$\sum_{n=1}^{n} B_n H_n^2$$

(here, $n$ being the number of blades).

Each blade of the multi-blade means has a central edge which is formed of two blade elements extending rearwardly (with a retard angle of 90°), as shown in FIG. 1(C). Such construction of the individual blade of the multi-blade means ensures smoother removal or push-away of the ditched soil, as compared with a planar ditching blade, and hence, a lower ditching resistance.

Figure 3:
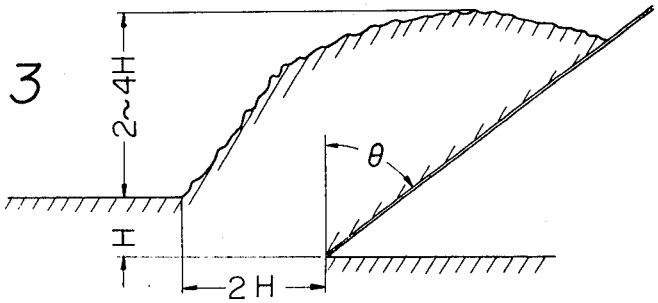

When a ditching blade of the aforesaid construction with a retard angle of 90° and an effective width of B digs a ditch of depth H, the soil is raised in front of the blade, starting from a position which is about 2H ahead of the central edge of the blade, as shown in FIG. 3. Accordingly, a steady flow of the soil is produced in front of the blade, in which flow the soil thus raised is further moved upwardly along the edge of the blade, and then the soil flow is divided to the opposing sides of the blade by the presence of the retard angle. The height of the soil thus raised depends on the nature of the soil of the sea floor and the scoop angle $\theta$ of the blade (FIG. 3). When the soil consists of pure sand and the scoop angle $\theta$ is small, e.g., 0° to 20°, the height of the raised soil in front of the blade is about 2H. On the other hand, when the scoop angle $\theta$ is large, e.g., about 60°, and the soil consists of mud alone or clay alone or a mixture of mud and small sand particles, the height of the soil thus raised in front of the blade may reach 4H or higher. The resistance to such soil raising in front of the blade is included in the aforesaid empirical equation of $R=kBH^2$ ($k$ being a constant), provided that the average height of the raised soil is comparatively low, e.g., about twice the excavating depth or about 2H.

In view of the facts described above, conventional cable-buriers actually use a four-blade ditching machine, in which each blade has the aforesaid retard angle and the effective width of any one blade is equivalent to 1.5 times the effective width of the next rearward blade (for limiting the height of the pushed-away soil to twice the excavating depth, as will be discussed in further detail hereinafter).

Figure 4:
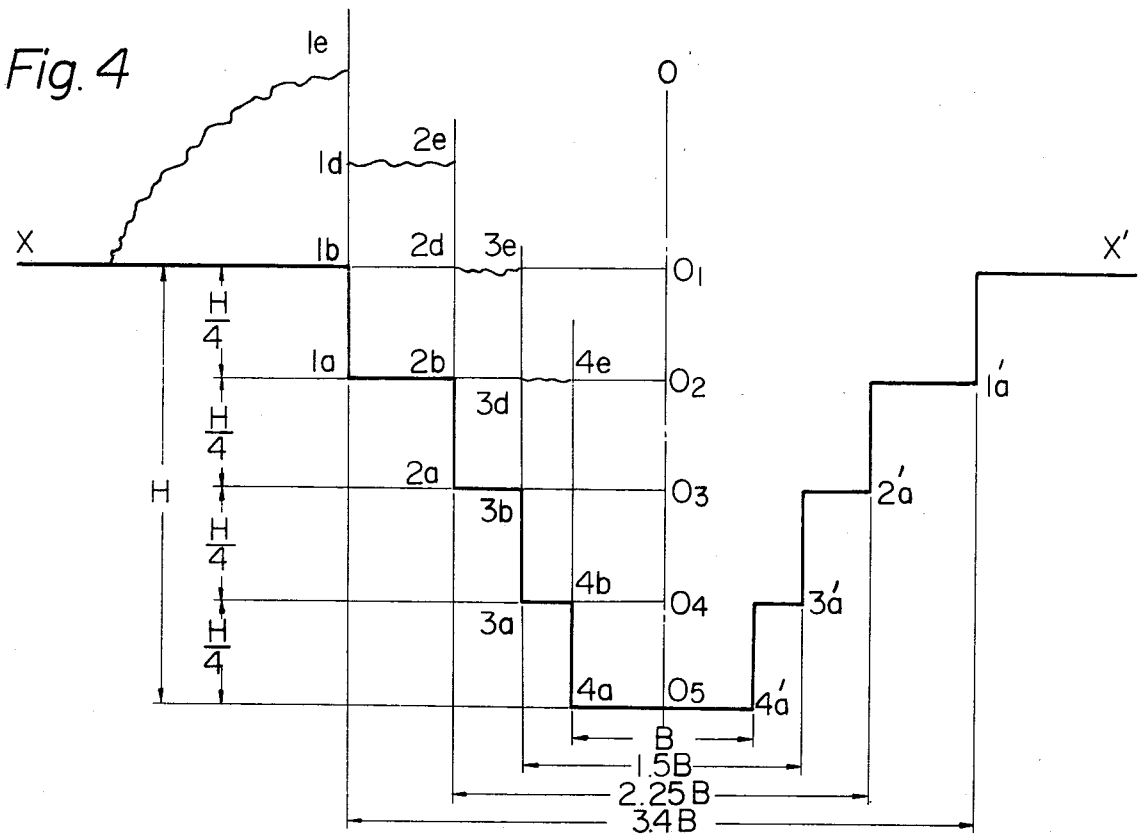
FIG. 4 is a schematic diagram illustrating the relation between the blade arrangement of a conventional ditching machine and the disposition of soil ditched by the ditching machine.

FIG. 4 illustrates the shapes and dispositions of blades of a four-blade ditching machine for digging a ditch of depth H and bottom width B in four steps, as seen from the front of the ditching machine. FIG. 4 also shows the cross sectional shape of the ditch which is ditched by the four-blade ditching machine, together with the location and average height of the soil ditched by the blades.

Referring to FIG. 4, since the left-hand half and the right-hand half of each blade are symmetrical with respect to the vertical central line $O\text{-}O_5$ of the blade, only the left-hand halves of the blades will be explained. The left-hand half of the first blade is represented by a rectangle $\overline{1e\cdot 1a\cdot O_2\cdot O}$, of which the lower portion as represented by a rectangle $\overline{1b\cdot 1a\cdot O_2\cdot O_1}$ is pushed into the sea floor by a depth of H/4 for ditching the soil with a given scoop angle, for instance, 65° relative to a vertical plane. The upper portion of the first blade, as represented by a rectangle $\overline{1e\cdot 1b\cdot O_1\cdot O}$, raises the soil thus ditched and pushes away the raised soil to the opposing sides, i.e., to the right and to the left. After this first blade has travelled, a ditch is formed on the sea floor surface which ditch has the same cross sectional shape as that of the aforesaid lower portion of the blade, and the ditched soil is pushed away to the left of the line 1e-1b and piled on the ground, as shown in the figure. Thereafter, the succeeding second blade $\overline{2e\cdot 2a\cdot O_3\cdot O}$ moves forwardly, so as to excavate the soil from an area, as represented by a rectangle $\overline{2b\cdot 2a\cdot O_3\cdot O_2}$, and to push away the ditched soil to the left of the line 2e–2b. The space $\overline{1d\cdot 1a\cdot 2b\cdot 2e}$ is filled up with the soil ditched by the second blade, and includes the space ditched by the foremost blade but outside the second blade.

If the effective width of the first or foremost blade is selected to be 1.5 times the effective width of the second blade, then the relation of $$\overline{1a2b} = \frac{1}{2}\,\overline{2aO_3}$$

is satisfied, and the height $\overline{2b2e}$ of the soil excavated by the second blade becomes H/2, provided that the area $\overline{2b\cdot 2a\cdot O_3\cdot O_2}$ = the area $\overline{1d\cdot 1a\cdot 2b\cdot 2e}$ and the excavating depth $\overline{2a2b}$ of the second blade is H/4. Thus, in this case, the height $\overline{2b2e}$ of the ditched soil is twice the excavating depth $\overline{2a2b}$. Similarly, the soil ditched by the third blade placed in a space $\overline{2d\cdot 2a\cdot 3b\cdot 3e}$, and the soil from the fourth blade excavation is placed in a space $\overline{3d \cdot 3a \cdot 4b \cdot 4e}$, and the height of such ditched soil is twice the ditching depth of the corresponding blade, for instance, the height of the ditched soil is H/2 provided that the ditching depth is H/4. Accordingly, if the effective width of the last stage or rearmost blade is represented by B, the widths of the foremost blade, the second blade, and the third blade are given by $1.5^3B = 3.4B$, $1.5^2B = 2.25B$, and 1.5B, respectively, as shown in FIG. 4. Since each of the four blades ditches a depth of H/4, the ditching resistance $R_4$ of this four-blade ditching machine can be determined by using the aforesaid empirical equation, namely, $$R_4 = k[3.4B(\frac{H}{4})^2 + 2.25B(\frac{H}{4})^2 + 1.5B(\frac{H}{4})^2 + B(\frac{H}{4})^2] = 0.51kBH^2.$$

As compared with the ditching resistance in the case of using single blade for making a ditch of the depth H and the width B, the aforesaid four blade ditching machine reduces the ditching resistance to about one half, and this calculation agrees with the results of field tests.

However, as mentioned before, the prior multi-blade ditching machine has a shortcoming in that each blade thereof is required to have an unnecessarily broad effective width in order to restrict the height of the soil ditched by the next following blade thereof, and each blade thereof requires the immediately preceding blade thereof to have a still broader effective width for the same reason.

The invention will now be described in detail, by referring to the embodiments as illustrated in the accompanying drawings.

Figure 5:
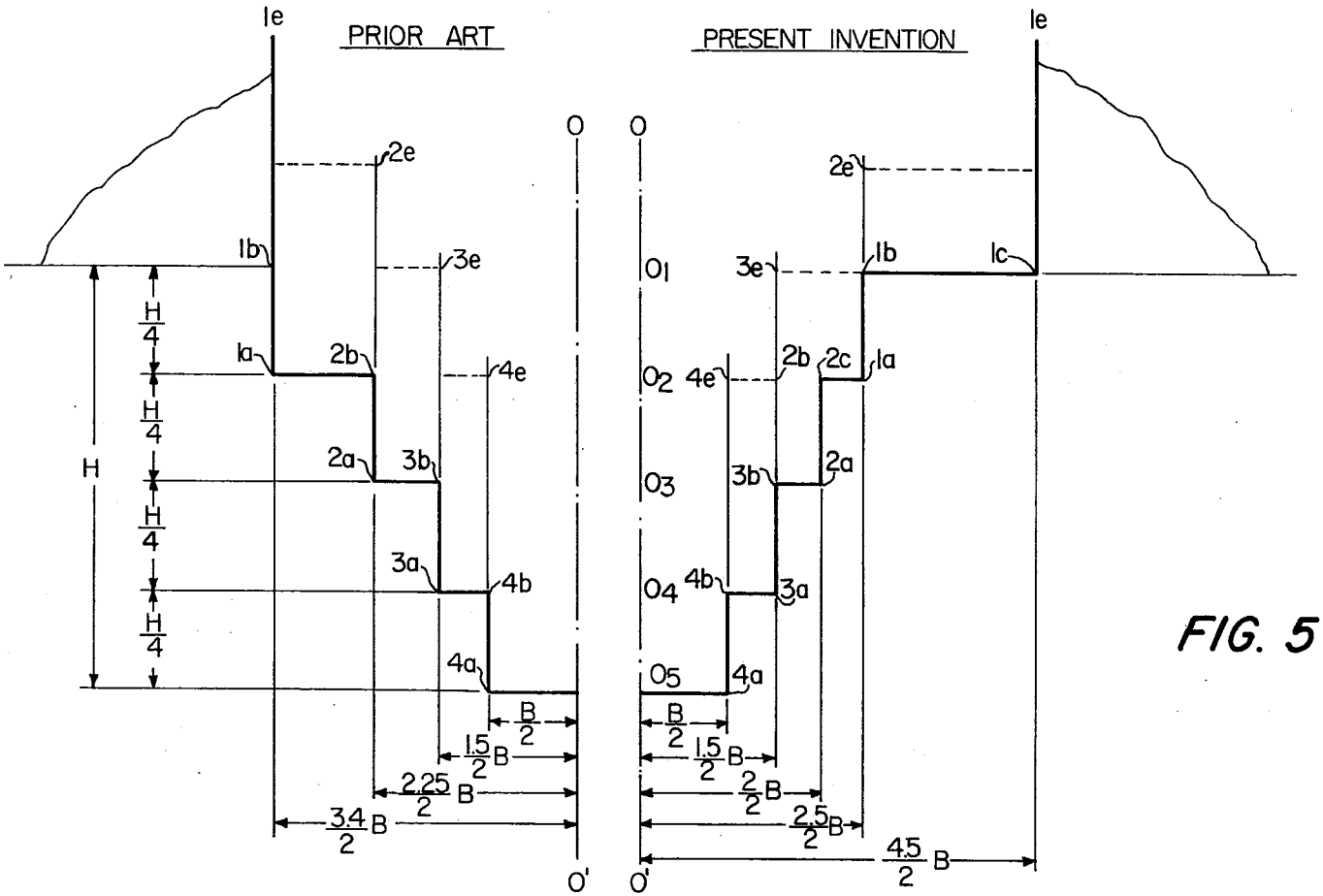
FIG. 5 is a schematic diagram illustrating the relation between the blade arrangement of a ditching machine according to the present invention and the disposition of soil ditched by the ditching machine, in comparison with the conventional relation as shown in FIG. 4.

An application of the present invention to a four-blade ditching machine will be explained at first. FIG. 5 shows, with a reduced scale, the cross section of a ditch with a bottom width B=30cm and a depth H=72cm, which ditch is ditched by a multi-blade excavator. The left-hand half of FIG. 5 is a reproduction of FIG. 4 (illustration of the conventional technique). The right-hand half of FIG. 5 illustrates a sectional view of a ditch ditched by a ditching machine according to the present invention, together with front views of blades thereof and the disposition of soil ditched thereby. The ditching machine for digging the ditch, as illustrated at the right-hand half of FIG. 5, includes four blades consisting of two new type blades, namely a most forward (i.e., the foremost) blade and a second or next succeeding blade according to the present invention, and two conventional type blades, namely a third blade and a fourth blade.

More particularly, as shown in FIG. 5 (only the right-hand half of each blade is shown), the foremost blade according to the present invention has a step-like shape $\overline{O \cdot O_2 \cdot 1a \cdot 1b \cdot 1c \cdot 1e}$, as seen from the front. A rectangular portion $\overline{O_1 \cdot O_2 \cdot 1a \cdot 1b}$ of the foremost blade performs the ditching, and the remaining portion of the foremost blade pushes away the ditched soil from the ditch. The second blade also has a step-like shape $\overline{O \cdot O_3 \cdot 2a \cdot 2b \cdot 2c \cdot 2e}$, of which a rectangular portion $\overline{O_2 \cdot O_3 \cdot 2a \cdot 2b}$ performs the ditching and the remaining portion performs the soil-pushing so that the width $\overline{O_2 \cdot 2c}$ of the soil pushing portion of the second blade is equal to the width $\overline{O \cdot 1b}$ of the ditching portion of the first blade. The third and the fourth blades have conventional rectangular shapes $\overline{O \cdot O_4 \cdot 3a \cdot 3e}$ and $\overline{O \cdot O_5 \cdot 4a \cdot 4e}$, respectively. Thus, different from the ditching portions, the third and fourth blades do not have separate soil-pushing portions, because such portions tend to complicate the structure of the ditching machine without producing any significant improvement of the performance thereof.

As is apparent from the comparison of the left-hand half and the right-hand half of FIG. 5, the blades of the conventional ditching machine are required to ditch a larger cross sectional area than the blades of the ditching machine of the present invention, despite the fact that the height of the ditched soil is the same for the two ditching machines. The ditching portion and the soil-pushing portion of each blade in the conventional ditching machine have the same effective width (as seen from the front of the ditching machine), as pointed out before.

More particularly, the foremost and the second blades of the conventional ditching machine have ditching widths of (3.4/2)B and (2.25/2)B, respectively. On the other hand, the ditching widths of the foremost and the second blades of the ditching machine according to the present invention are reduced to (2.5/2)B and B, respectively. As regards the widths of the soil-pushing portions, the conventional foremost and second blades have widths of (3.4/2)B and (2.25/2)B, respectively, while the foremost and second blades of the present invention have widths of (4.5/2)B and (2.5/2)B, respectively, as shown by the distances to lines 1e–1c and 2e–2c in FIG. 5. Generally speaking, the resistance against horizontal push-away of the ditched soil on the retarding blade elements in a gravitational field is negligible, as compared with the ditching resistance. Thus, the ditching resistance is not influenced by the horizontal push-away of the ditched soil to the left and right of the ditch. Therefore, the ditching resistance for the four-blade ditching machine according to the present invention can be determined by using the aforesaid empirical equation, namely, $$R_4(\text{right}) = k\,[\,2.5B\,(\frac{H}{4})^2 + 2B(\frac{H}{4})^2 + 1.5B\,(\frac{H}{4})^2 + B\,(\frac{H}{4})^2\,] = 0.44kBH^2.$$

The corresponding resistance for the conventional four-blade ditching machine was calculated in the foregoing, namely, $$R_4(\text{left}) = 0.51kBH^2$$

Thus, $$R_4(\text{right})/R_4(\text{left}) = 0.86$$

Accordingly, the four-blade ditching machine according to the present invention reduces the ditching resistance by more than 10%, as compared with the conventional four-blade ditching machine.

In the foregoing description, the ditching portion and the soil-pushing portion of each blade are assumed to be rectangular, so that the overall sectional view of the ditch has step-like side walls. It is, however, preferable to use trapezoidal blades, so as to form substantially V-shaped smooth side walls, because the trapezoidal blades make the push-away of the ditched soil easier.

Figure 6A:
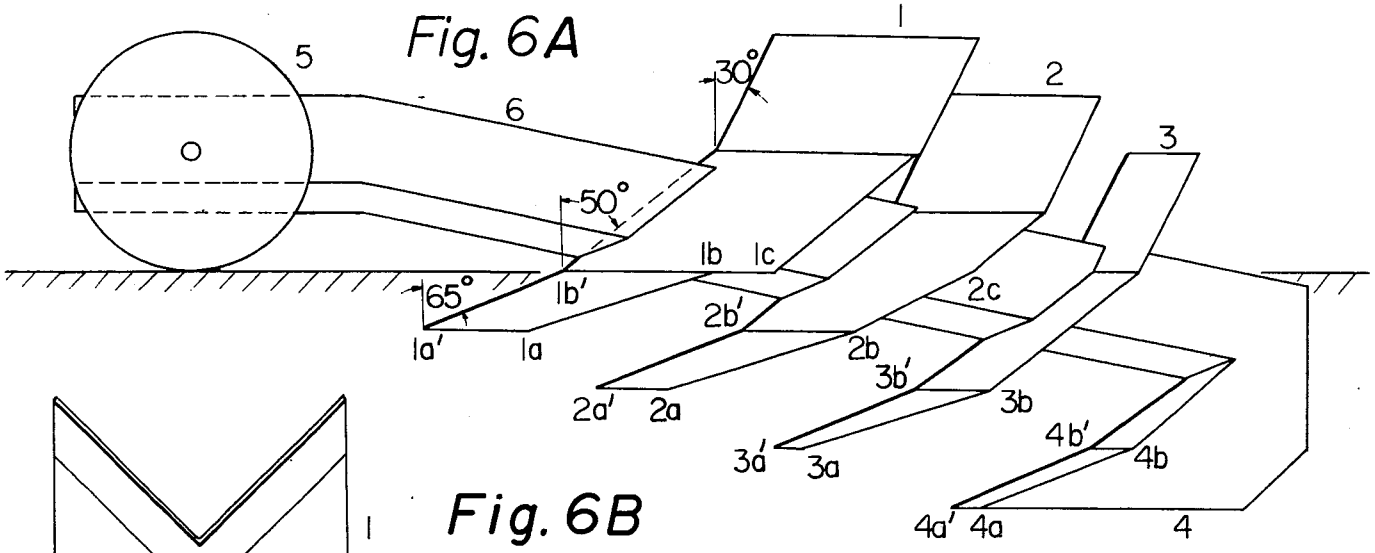
FIGS. 6A, 6B, and 6C are different views of the structure of blades and a ditching machine, according to the present invention.
Figure 6B:
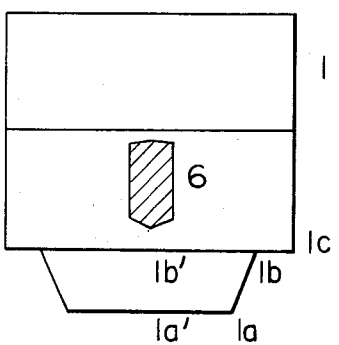
Figure 6C:
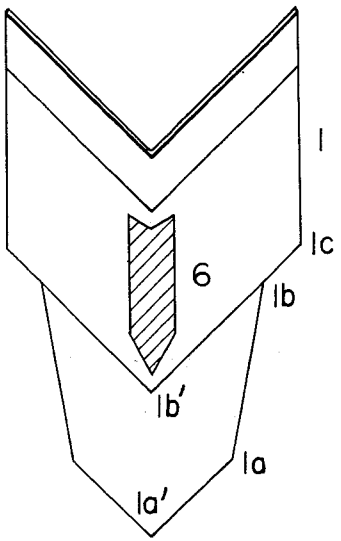

The structure of an embodiment of the present invention will now be described. FIG. 6A illustrates a side view of a cable-searcher according to the present invention. FIG. 6B shows a front view of a foremost blade thereof, and FIG. 6C illustrates a plan view of the foremost blade. The ditching machine in this embodiment uses trapezoidal blades. A pair of stabilizing wheels 5 (only one wheel is shown) act to stabilize the horizontal posture of the ditching machine and to place the head portion of the cable-searcher in position. It should be noticed that, in the embodiment of FIG. 6(A), a stabilizing wheel (a stabilizing roller) 5 is provided instead of a sledge in the embodiment of FIG. 1(A), therefore, the frictional resistance of the stabilizing means is reduced and the operation of the ditching machine or the cable burier is much improved. Four blades 1, 2, 3, and 4 are secured to a body 6 of the ditching machine at uniform intervals, starting from the head portion thereof, as shown in FIG. 6A. Each of the four blades ditches the soil with a depth of about 20 cm, and when the bottom tail end of the fourth blade 4 assumes a horizontal posture, the front edge 4*a'* of the fourth blade is located about 80 cm below the surface of the sea floor. Thus, any cables or the like which are laid in the sea floor surface of about 80 cm depth can be pulled out by one of the four blades of the cable-searcher.

Each of the forward three blades 1, 2, and 3 of the four blades comprises three portions having scoop angles of 65°, 50°, and 30°, respectively. The portions with the scoop angle 65° ditch, and other portions push away the ditched soil. The top edge 1*b*–1*b'* of the ditching portion of the first blade 1 is positioned on the surface level of the sea floor when the cable-searcher operates normally with a proper ditching depth, and this top edge is longer than the bottom edge thereof ($\overline{1b1b'} > \overline{1a1a'}$), so that the first blade ditches a ditch with a trapezoidal cross section. The length of the top edge $\overline{2b2b'}$ of the ditching portion of the second blade is selected to be the same as that of the bottom edge of the first blade ($\overline{1a1a'} = \overline{2b2b'}$), so that the ditches ditched by the first and second blades have side walls which are continuous. As a result, the aforesaid V-shaped side walls are produced. (other blades are similarly shaped.)

The soil ditched by the first blade is horizontally pushed away to the edge 1*c* of the blade 1 or further. (Conventionally, the ditched soil is pushed away only to the edge 1*b* or further.) Point 2*c* of the second blade 2 is normally located at the sea floor surface level, so that the soil ditched by the ditching portion $\overline{2a \cdot 2a' \cdot 2b' \cdot 2b}$ is carried up to the level of the point 2*c* by the portion with the scoop angle 50° and then horizontally pushed away from this point onto the surface of the sea floor (in the same manner as described hereinbefore by referring to FIG. 5).

Figure 7:
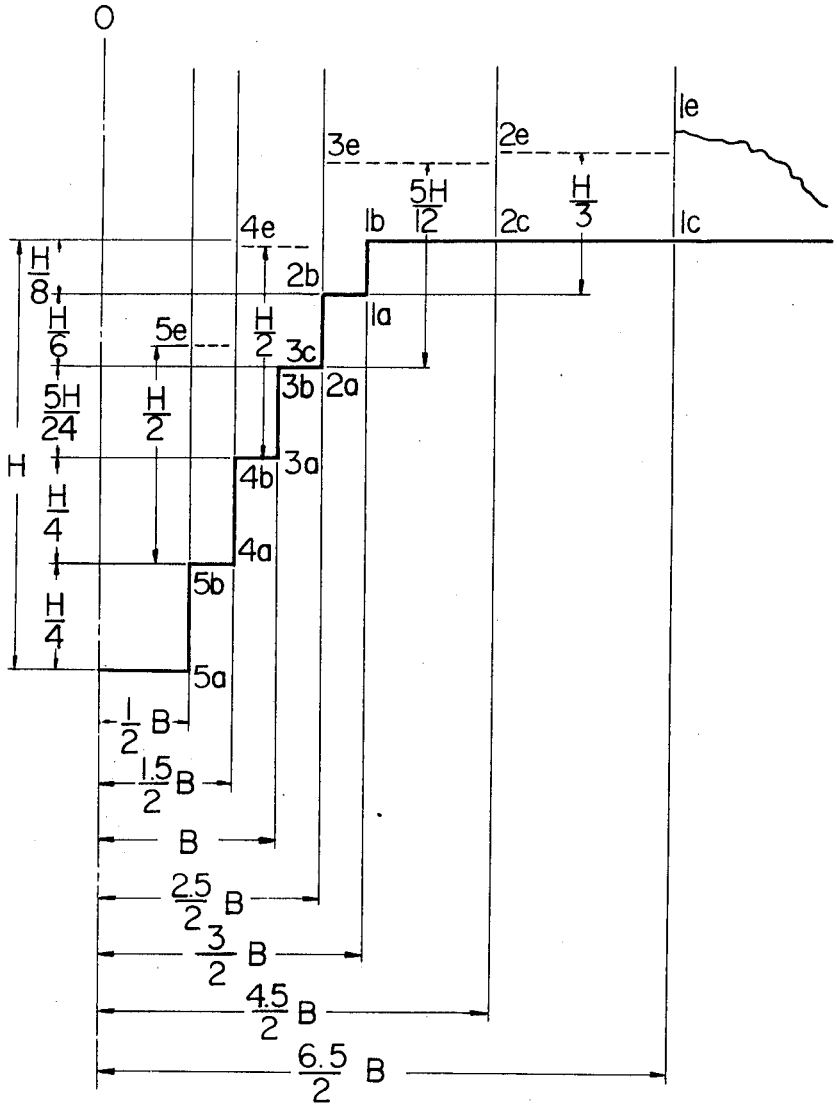
FIG. 7 is a schematic diagram illustrating the relation between the blade arrangement of another ditching machine according to the present invention and the disposition of soil ditched by the ditching machine.

FIG. 7 illustrates a cross section of a ditch ditched by a five-blade ditching machine according to the present invention, which ditching machine has one additional blade as compared with the four-blade ditching machine. The figure shows only the right-hand side of the blades, as seen from the front of the dtiching machine, in a similar manner to the illustration of FIGS. 4 and 5. In order to minimize the amount of soil to be pushed away by the foremost blade through the third blade, the depths to be ditched by the foremost, second, and third blades are selected to be H/8, H/6, and 5H/24, respectively (H being the total depth of ditching by the ditching machine). The ditching depths of the fourth and the fifth blades are both H/4, which is the same as that of each blade of the aforesaid four-blade ditching machine. Thus, in the embodiment of FIG. 7, the ditching depth of the individual blade is deepened as the blade is positioned more rearwardly, except for the rearmost blade.

The outer edges of the ditching portions of the five blades are represented by 1*a*, 2*a*, 3*a*, 4*a*, and 5*a* in FIG. 7, respectively. The cross sectional shape of the ditch is reduced to that of a V-shaped ditch with an angle of 25°. The soils ditched by the foremost, second, and third blades are pushed away to the positions 1*c*, 2*c*, and 3*c*, respectively, so as to restrict the height of the ditched soil to less than twice the depth of the corresponding blade.

The ditching resistance $R_5$ of the multi-blade ditching machine of FIG. 7 can be determined by using the aforesaid empirical equation and the dimensions of the figure, namely, $$R_5 = k\,[\,3B(\tfrac{H}{8})^2 + 2.5B(\tfrac{H}{6})^2 + 2B(\tfrac{5}{24}H)^2 + 1.5B(\tfrac{H}{4})^2 + B(\tfrac{H}{4})^2 2] = 0.36kBH^2.$$

Thus, the five-blade ditching machine according to the present invention can further reduce the ditching resistance by about 20%, as compared with the ditching resistance $R_4 = 0.44kBH^2$ of the four-blade embodiment of the invention, and the ditching resistance $R_5$ of the five-blade ditching machine is about one third of that of the conventional one-blade plow-type ditching machine.

To bury cables or the like in the open sea over a long distance, the burying operation must be carried out at a comparatively high speed, e.g., not slower than about 5 Km/hour, in view of the need for maneuvering a cable-laying ship relative to tide and variations of the oceanic conditions. The ditching blades having the aforesaid retard angles are highly effective in carrying out such a high-speed cable burying in the sea bottom. If ditching blades having scoop angles of about 60° are used, the height of the ditched soil becomes fairly high, and the height of twice the ditching depth of each blade, as used in the foregoing explanation of the embodiments, is rather conservative. Under the aforesaid conditions, past experiences show that the natural height of the ditched soil may reach as high as four times the ditching depth of each blade, and the aforesaid empirical equation of $R = k\Sigma BH^2$ stands.

As pointed out in the foregoing, the side edges of the soil-pushing portions of the foremost blade and the second blade of FIG. 7 are extended to the positions 1*c* and 2*c*. However, since the natural height of the ditched soil may reach four times the ditched depth of each blade, the horizontal width of the soil-pushing portion of the blade may be reduced, without causing any significant increases of the ditching resistance.

Thus, according to the present invention, a six-blade or seven-blade ditching machine can be constructed for realizing the merit of the multi-blade ditching machine, without necessitating any very wide blades.

In ditching machines having a very large number of blades, it is important to maintain proper spacings between adjacent blades, so as to prevent the soil ditched by one blade from coming in contact with the backside of the immediately preceding blade, because such contact tends to hamper the natural rise and the push-away of the ditched soil. If the maintenance of the proper spacings between adjacent blades fails, the inter-blade spaces would be filled up with the ditched soil, the so-called "plugged blades" condition would be caused and the ditching function of the related blades would be completely lost. Such plugged blades are apparently undesirable.

The application of the multi-blade ditching machine according to the present invention is not restricted to the aforesaid cable-buriers and the cable-searchers, but the structure of the present invention can be applied to various kinds of multi-blade excavators of earth and sand.

As is apparent from the foregoing disclosure, the structure of a multi-blade ditching machine according to the present invention minimizes the width of the ditching portion of a forward blade and expands the width of the soil-pushing portion of the blade for removing the ditched soil far away from the ditch so as to reduce the ditching resistance and to provide a light-weight multi-blade ditching machine. Furthermore, the present invention prevents any increase in the ditching cross sectional area even if the number of blades in a ditching machine is increased, which area increase has been a bottleneck in conventional ditching machines. Consequently, the present invention reduces the traction which is necessary for towing cable-buriers and cable-searchers. Thus, the present invention produces outstandingly useful effects.

From the foregoing, it will now be apparent that a new and improved ditching machine has been found. It should be understood of course that the embodiments disclosed are only illustrative and are not intended to limit the scope of the invention. Reference should be made to the appended claims, therefore, rather than the specification as indicating the scope of the invention.

What is claimed is:

1. A multi-blade ditching machine having a plurality of blades adapted for ditching and pushing soil disposed along the longitudinal axis thereof substantially at uniform intervals; the blades which are positioned at the rear portion of said ditching machine having a greater vertical length and smaller horizontal extent transverse to the direction of movement than the more forwardly disposed blades and adapted to ditch more deeply with narrower ditching widths, said ditching machine being further characterized in that at least the two most forward of the blades have a ditching means for ditching soil and a soil-pushing means for pushing said soil substantially horizontally in a direction lateral to moving direction of the ditching machine, said soil-pushing means being at the top of said ditching means and having a wider horizontal width as seen from front of the ditching machine than that of said ditching means when the ditching machine is in a normal operating posture the width of the soil pushing and ditching means of each of said most forward blades being respectively narrower proceeding consecutively from the front to the rear of the machine.

2. A multi-blade ditching machine according to claim 1, wherein the number of said blades is four.

3. A multi-blade ditching machine according to claim 1, wherein the number of said blades is five.

* * * * *